United States Patent [19]

Bothner

[11] Patent Number: 4,558,944

[45] Date of Patent: Dec. 17, 1985

[54] APPARATUS FOR ESTABLISHING A PREDETERMINED INTERFACE BETWEEN A DIELECTRIC SHEET AND AN ELECTROGRAPHIC PROCESS STATION

[75] Inventor: Carl R. Bothner, Rochester, N.Y.

[73] Assignee: Eastman Kodak Company, Rochester, N.Y.

[21] Appl. No.: 635,040

[22] Filed: Jul. 27, 1984

[51] Int. Cl.[4] ..... G03G 21/00

[52] U.S. Cl. ..... 355/3 SH; 355/16; 355/73; 355/4; 271/197; 271/276

[58] Field of Search ..... 355/16, 3 R, 73, 76, 355/3 SH, 14 SH, 4; 101/DIG. 13; 271/196, 197, 276

[56] References Cited

U.S. PATENT DOCUMENTS

| | | | |
|---|---|---|---|
| 2,961,951 | 11/1960 | Nitchie | 101/415.1 |
| 3,190,199 | 6/1965 | Clark | 355/3 SH |
| 3,314,624 | 4/1967 | Louzil et al. | 242/55.12 |
| 3,536,400 | 10/1970 | Griffin, Jr. | 355/15 |
| 3,853,315 | 12/1974 | Dahlgren | 271/204 |
| 4,436,405 | 3/1984 | Kindt | 355/4 X |
| 4,437,659 | 3/1984 | Caron et al. | 271/276 |

*Primary Examiner*—R. L. Moses

*Attorney, Agent, or Firm*—Larry P. Kessler

[57] ABSTRACT

Apparatus for use in an electrographic copier having a plurality of electrographic process stations for forming visible images on the surfaces of discrete dielectric sheets. Such apparatus establishes a predetermined operative interface between a discrete dielectric sheet and an electrographic process station so that the function of such process station is uniformly applied to the surface of such dielectric sheet. The apparatus includes a member for supporting a dielectric sheet, such member having a sheet supporting surface mounted for movement along a path from a location remote from a process station to a location which is a predetermined distance from such station and then away from such station. As such supporting surface moves along such path, an edge of a discrete dielectric sheet is clamped to the member and successive portions of the surface area of such sheet measured from such clamped edge are tacked to the supporting surface of the member as such portions are moved with the supporting surface to the location a predetermined distance from such process station. The moving member thus supports and transports the tacked sheet whereby the function of such process station is uniformly applied to the surface of such sheet.

7 Claims, 9 Drawing Figures

APPARATUS FOR ESTABLISHING A PREDETERMINED INTERFACE BETWEEN A DIELECTRIC SHEET AND AN ELECTROGRAPHIC PROCESS STATION

BACKGROUND OF THE INVENTION

This invention relates generally to apparatus associated with electrographic process stations, and more particularly to apparatus for establishing a predetermined interface between a discrete dielectric sheet and an electrographic process station.

In U.S. Pat. No. 4,436,405 issued Mar. 13, 1984, in the name of Kindt, an electrographic copier is described which utilizes a plurality of discrete photoconductive sheets. The sheets are transported seriatim about a continuous path into operative relation with electrographic process stations to make information reproductions. In the reproduction process carried out at such process stations of the copier, a sheet is uniformly charged and then exposed by an image of information (e.g. a document) to be reproduced to form a latent image charge pattern on such sheet corresponding image-wise to such information. The charge pattern is developed with pigmented thermoplastic electroscopic marking particles electrostatically attracted to the charge pattern to form a visible transferable image. The transferable image is then transferred from the sheet to a receiver member to form the information reproduction, and the sheet is cleaned for reuse. An advantage of using the plurality of discrete photoconductive sheets, as contrasted to the use of a continuous photoconductive web or drum, is that the speed of the sheets, as they move through the process stations, can be varied to optimize the operation of each process station on the sheets.

The discrete photoconductive sheets must be accurately positioned relative to the respective electrographic process stations while in operative relation to such stations. That is, every sheet must exhibit the same predetermined interface with a particular process station over their respective surface areas. For example, in the charging station, the point-to-point spacing from the corona charger to the surface of a sheet as the sheet travels past the charger must be equal to ensure that a uniform charge is laid down on the sheet; and in the transfer station, successive elements of the sheet surface must be uniformly associated with a receiver member to ensure complete transfer of a marking particle image on the sheet to the receiver member.

In the aforementioned Kindt patent, an arrangement is provided for transferring images from discrete photoconductive sheets to receiver members, and a track assembly supporting opposed marginal edges of sheets guides such sheets through other of the electrographic stations. Such transfer arrangement requires that the sheets be stopped during transfer. Stoppage of the sheets, while having certain advantages, complicates the construction of the transfer apparatus arrangement and may increase the overall process time required to make a reproduction. Further, the track assembly for guiding the sheets relies on the beam strength of the sheets to support such sheets over their respective surface areas to ensure uniformity of process station function on the sheets at the interface of the sheets to the process stations. Such beam strength may not always be sufficient to ensure the desired interface to accomplish such uniformity of function.

SUMMARY OF THE INVENTION

This invention is directed to apparatus for use in an electrographic copier having a plurality of electrographic process stations for forming visible images on the surfaces of discrete dielectric sheets. Such apparatus establishes a predetermined operative interface between a discrete dielectric sheet and an electrographic process station so that the function of such process station is uniformly applied to such dielectric sheet. The apparatus includes a member for supporting a dielectric sheet, such member having a sheet supporting surface mounted for movement along a path from a location remote from a process station to a location which is a predetermined distance from such station and then away from such station. As such supporting surface moves along such path, an edge of a discrete dielectric sheet is clamped to the member and successive portions of the surface area of such sheet measured from such clamped edge are tacked to the supporting surface of the member as such portions are moved with the supporting surface to the location a predetermined distance from such process station. The moving member thus supports and transports the tacked sheet whereby the function of such process station is uniformly applied to the surface of such sheet.

The invention, and its objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which.

DESCRIPTION OF THE PREFERRED EMBODIMENT

Figure 1:
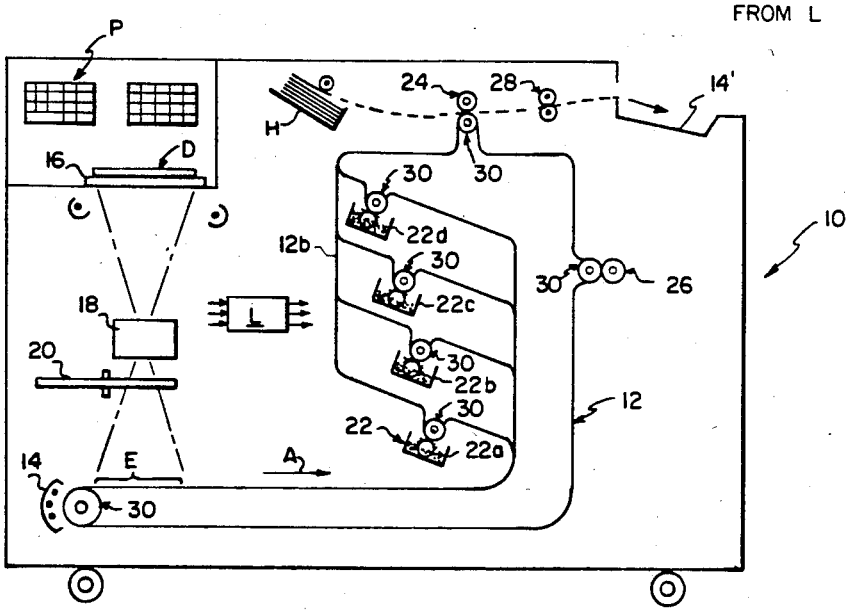
FIG. 1 is a schematic illustration of an electrographic copier utilizing discrete dielectric sheets and including apparatus, according to this invention, for establishing predetermined operative interfaces between dielectric sheets and electrographic process stations of such copier.
Figure 4:
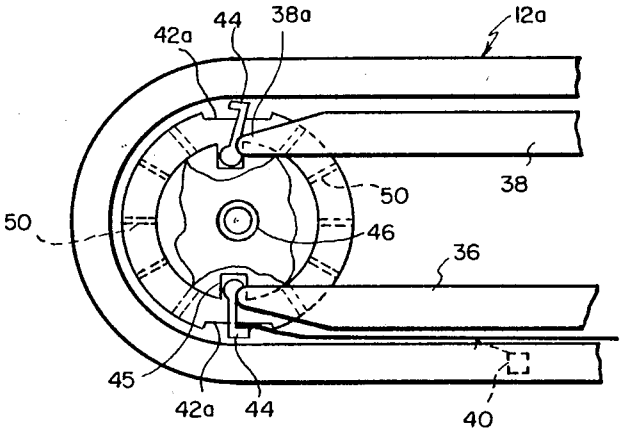
FIGS. 3 through 9 are side elevational views of an interfacing apparatus, adapted to be associated with an exemplary electrographic process station, taken at progressive stages in the operation of such apparatus.

Referring now to the accompanying drawings, an electrographic copier, designated generally by the numeral 10, is shown schematically in FIG. 1. The copier 10 includes a track assembly 12 about which discrete dielectric sheets are transported seriatim, in the direction indicated by arrow A, into operative relation with typical electrographic process stations. The discrete dielectric sheets are formed of cut sheets of film material and include an insulating layer and a photoconductive layer such as described for example in U.S. Pat. No. 3,615,414, issued Oct. 26, 1971, in the name of Light. The track assembly 12 includes spaced parallel channels supportably engaging opposed marginal edges of the sheets and providing an electrical ground for such sheets. Transport of the sheets about the track assembly is effected, for example, by drive rollers (not shown) engaging such marginal edges.

Control of the copier 10 is accomplished by a logic and control unit L including a microprocessor for example. The microprocessor receives operator input signals from an input panel P and timing signals, for example from sensors (not shown) detecting arrival or departure of the sheets at particular locations as they are transported about the track assembly 12. Based on such signals and a program for the microprocessor, the unit L produces signals to control the timing of transport of the sheets about the track assembly and operation of the various electrographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

In the operation of the copier 10, a grounded discrete dielectric sheet is transported past a corona charger 14, where it receives a uniform electrostatic charge, to an exposure zone E. In the exposure zone, the sheet is exposed to selectively reduce the uniform charge to form a latent image charge pattern corresponding, image-wise, to information to be reproduced. In the illustrative embodiment, exposure is accomplished by directing a reflected light image from a document D supported on a transparent platen 16 through a lens 18 and a filter wheel 20 to a sheet in the exposure zone E. Of course other optical or electrical arrangements for forming an image-wise charge pattern on the sheet are suitable for use with this invention.

After the latent image charge pattern is formed on the sheet, the sheet is transported through a developer station 22. In the developer station, the pattern is developed by electrostatically adhering pigmented electroscopic marking particles to the pattern by a magnetic brush developer, for example, to form a visible transferable image on such sheet. The sheet bearing a transferable image is then transported through a transfer apparatus 24 where the image is electrostatically transferred to a receiver member (e.g. cut sheet of plain paper) fed to the transfer apparatus from a supply hopper H. The transfer apparatus 24 is, for example, of the type described in U.S. Pat. No. 4,410,263 issued Oct. 18, 1983 in the name of Gustafson et al. After transfer, the sheet is transported through a cleaning station 26, where any residual marking particles are removed, and returned to the vicinity of the charger 14 for reuse. Concurrently, the receiver member, bearing the transferred image, is transported through a fuser station 28 where such image is fixed to such member by heat and/or pressure and delivered to an exit hopper H' for operator retrieval.

For each monochromatic reproduction to be made, one reflected light image of the document is passed through a neutral density sector of the filter wheel to expose one sheet. The charge pattern formed on the sheet by such exposure is developed, for example, by magnetic brush developer **22*d* in station 22** to form the transferable image. On the other hand, for each multicolor reproduction to be made, a plurality of reflected light images of the document are successively passed through different color sectors of the filter wheel to expose a plurality of sheets respectively. With a subtraction color reproduction process, the color sectors of the filter wheel are of primary colors respectively. The charge patterns formed on the sheets by such exposures are then respectively developed with complementary colored marking particles to form the transferable images.

Development of the latent image charge patterns is accomplished by directing the pattern-carrying sheets through branched portion **12*b* of the track assembly 12 respectively into operative association with magnetic brush developers 22*a*–22*c*, for example, of developer station 22. The magnetic brush developers 22*a*–22*c* contain electroscopic marking particles of a respective color corresponding to the complement of a primary color. Sheets exposed to a certain primary color are then directed into association with the developer containing particles of the color complementary to that color. Of course the magnetic brush developer 22*d*, containing for example black marking particles, may be used to develop a charge pattern (related to the charge patterns produced by exposure through the color filter sectors) exposed on a sheet through a neutral density filter sector. During transfer, the receiver member is retained in the transfer station 24** and the transferable images are transferred sequentially to the member in accurate superimposed register to form a composite multi-color image on such member.

In the electrographic process stations, the discrete dielectric sheets must be accurately controlled at the respective interfaces to ensure proper predetermined operative relation of the sheets with the stations. Such control at the electrographic process station interfaces is accomplished by the apparatus according to this invention, designated generally in the drawings by the numeral 30. The interfacing apparatus 30 are, for example, associated with the charging station 14, magnetic brush developers **22*a*–22*d*, transfer station 24, and cleaning station 26**.

Figure 2:
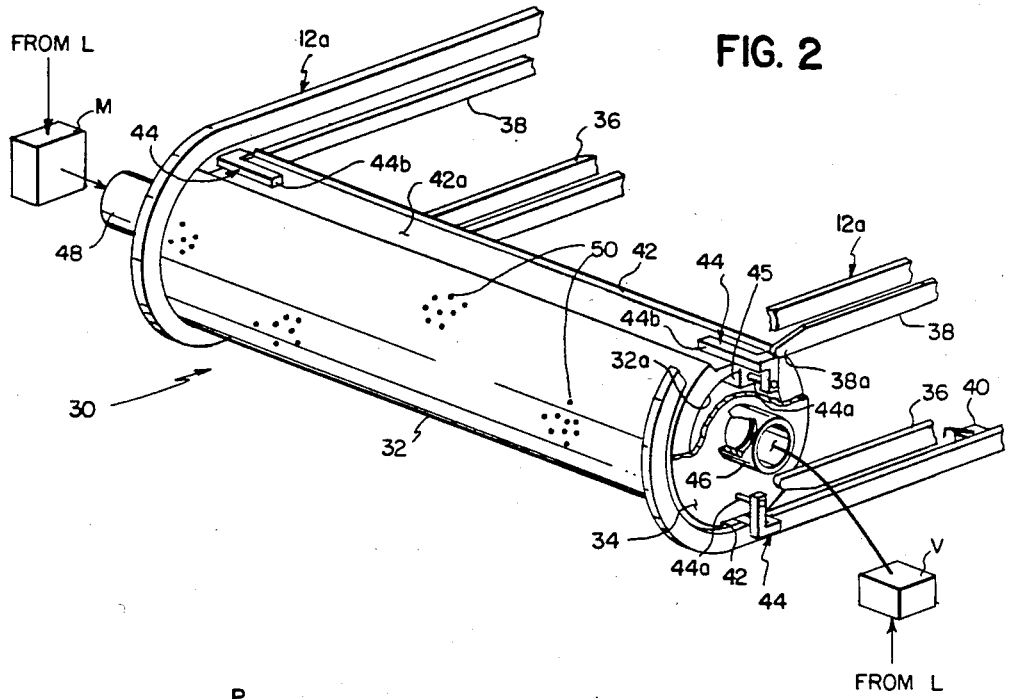
FIG. 2 is a view, in perspective, of an interfacing apparatus according to this invention with portions broken away or removed to facilitate viewing.

FIG. 2 best shows the arrangement of one of the interfacing apparatus 30, each of the other of such apparatus being of substantially identical construction. The apparatus 30 includes a hollow cylindrical housing 32 closed by end caps 34 forming an interior chamber **32*a*. Shafts 46,48 coincident with the longitudinal axis of housing 32 are coupled to the end caps 34. The shafts are supported in the copier 10 for rotation in bearings (not shown) particularly located with respect to a related process station; that is, for example, at a predetermined distance from the related process station. The housing is thus supported for rotation about its longitudinal axis, with the surface of such housing being movable in a path, a portion of such path lying in predetermined operative spatial relation with such electrographic process station. For example, a portion of such surface area adjacent to a certain station, such as the charger 14, exhibits equal point-to-point spacing of the surface area to the corona wires (spaced substantially parallel to the longitudinal axis of housing 32) of charger 14 to ensure a uniform charge field at such surface portion; or successive elements (line segments) of such surface area are brought into juxtaposition with a certain station, such as the magnetic brush developers of the developer station 22, transfer roller of station 24, or cleaning brush of station 26**.

Figure 3:
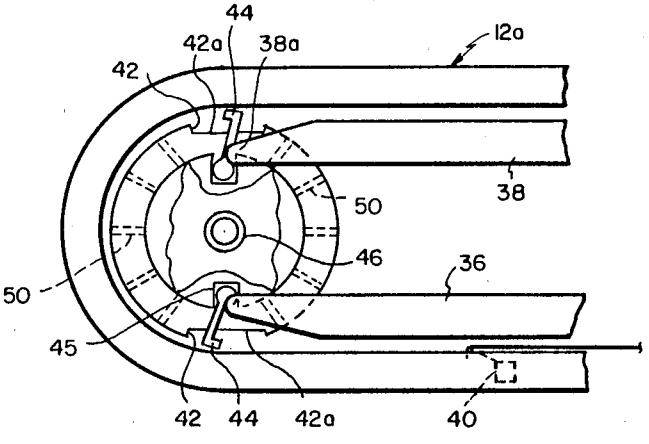

The track assembly 12 includes a plurality of portions **12*a* associated with the plurality of interfacing apparatus 30 respectively. Each portion 12*a* has an entrance section 36 and an exit section 38 for guiding a discrete dielectric sheet respectively to and from the housing 32 of the interfacing apparatus. Section 36** defines a plane for the guided sheets substantially tangent to the housing 32 upstream of the process station with which the housing is associated; and section 38 defines a plane for the guided sheets substantially tangent to the housing 32 downstream of such process station. As shown, the planes defined by sections 36 and 38 are parallel. Of course, depending upon the space requirements adjacent to a process station, such planes may be at an angle with respect to one another. A switch 40, located adjacent to section 36 of the track assembly upstream of the associated process station, intercepts the discrete dielectric sheet travel path. When a sheet transported through the section 36 contacts the switch 40 (see FIG. 3), such switch is actuated and a signal is sent to the logic and control unit L to control timing of operation of the interfacing apparatus (as explained hereinbelow) and, if required, its associated process station (e.g., apply electrical potential to the charger).

In order to secure a discrete dielectric sheet to the housing 32 for transport through the associated process station, the housing has at least one recess 42 in its peripheral surface extending parallel to the longitudinal axis of the housing. Clamps 44 are supported respectively on pins 44*a* extending through the end caps 34 adjacent to the recess 42, and include arms 44*b* respectively overlying the recess (see FIG. 2). The clamps 44 are selectively pivotable by, for example, rotary solenoids 45 (one shown) supported in the housing 32 and coupled to the pins 44*a* respectively. Rotation of the solenoids causes arms 44*b* to attach the lead edge of a sheet to the bottom land 42*a* of the recess 42. In the preferred embodiment shown in FIGS. 2–9, two recesses 42 and associated clamps 44 of substantially identical structure are provided.

At a predetermined time after the switch 40 detects a sheet (which time is based on transport speed of the sheet), the logic and control unit L actuates the solenoids 45. The solenoids are rotated in the direction to pivot clamps 44 (associated with the recess adjacent to the section 36 of the track assembly) to capture the lead edge of incoming sheet and attach such lead edge to the housing 32 (see FIG. 4) in the manner described above. Substantially simultaneously, the unit L actuates motor M coupled to shaft 48 (in any well known manner) to initiate rotation of the housing 32; and, if required, the operative condition of the associated process station is effected by the unit L.

Figure 5:
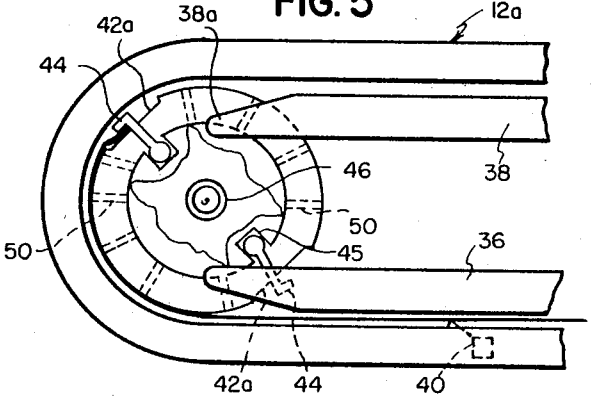
Figure 8:
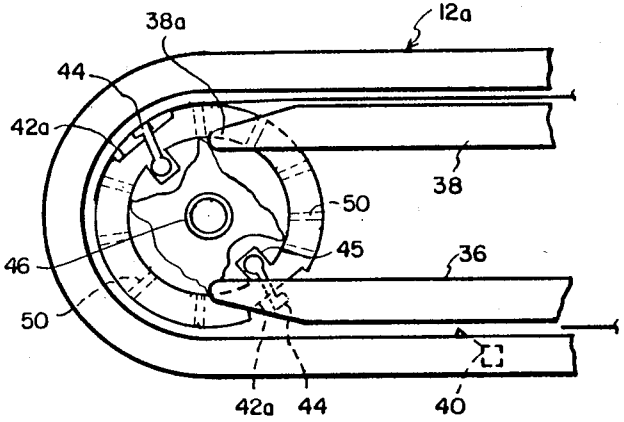
Figure 7:
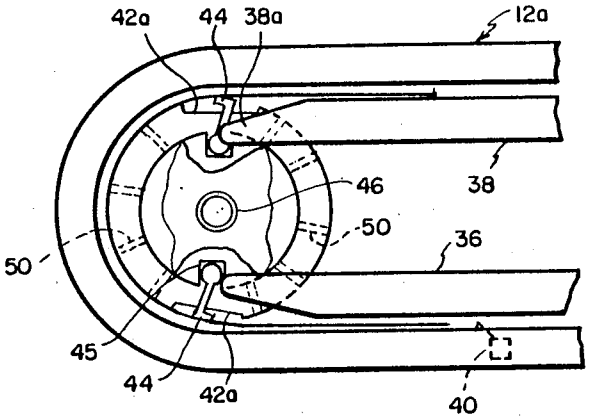
Figure 9:
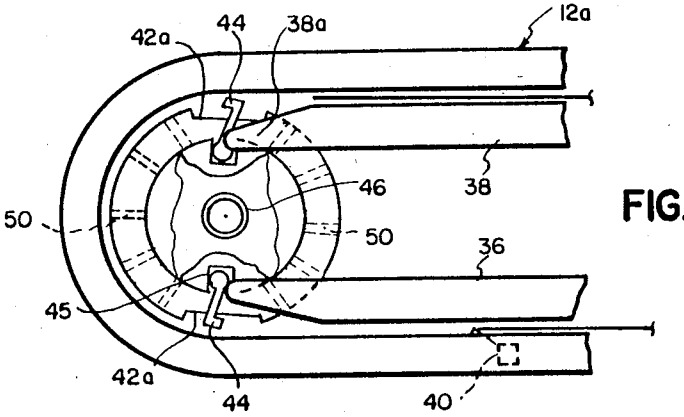

As the housing 32 rotates, the attached sheet is towed, through the predetermined operative spatial relation to the associated process station, toward track assembly section 38 (see FIG. 5). The angular speed of rotation of the housing is selected to transport the sheet through the associated process station at a speed which is optimal for the particular function applied to such sheet by such station. Further, the towing of the lead edge of the sheet causes successive elements of the attached sheet to contact the housing 32. Such elements are tacked to the housing 32 by vacuum from a source V selectively coupled to the interior chamber 32*a* of the housing by unit L and effective through ports 50 extending through the wall of the housing. Due to the fact that the surface of the housing moves in the path where it is brought into the predetermined relation adjacent to the associated process station (e.g. a predetermined distance from such station), the surface of the attached sheet is transported so that the desired interface between the attached sheet surface and such process station is accomplished; that is, the sheet is in association with such station whereby the function of the station is uniformly applied to the surface of such sheet.

Figure 6:
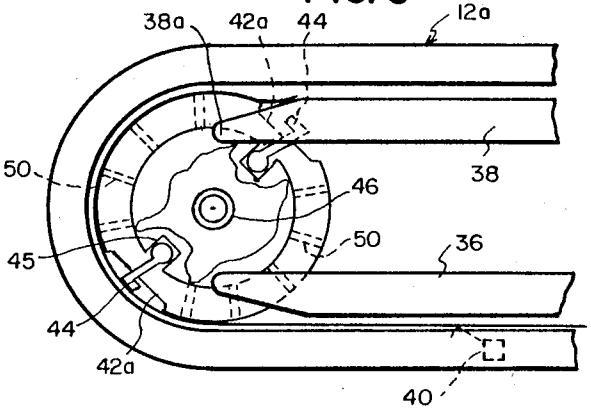

As the housing 32 is rotated through the location where the recess bearing the clamped lead edge of the discrete dielectric sheet approaches track assembly section 38, the unit L actuates the solenoids 45 to rotate in a direction in which clamps 44 are pivoted away from their clamping location to release such lead edge (see FIG. 6). As the lead edge release is occurring, the housing 32, with the sheet still vacuum tacked to its surface, continues to be rotated. The lead edge of such sheet is brought into engagement with extended portions 38*a* (one shown) of section 38. Accordingly the lead edge of the sheet is stripped from the housing 32 by such portions 38*a* and guided into section 38 to be led away from the process station while the remainder of the sheet is moved through the process station (see FIGS. 7, 8) in the desired operative relation. After the trail edge of the sheet leaves the housing 32, the transport drive of the track assembly 12 transports the sheet away from the housing. The housing is then rotated to position a recess 42 adjacent to track assembly section 36 to receive the next sheet directed from section 36 to the housing 32 (see FIG. 9) so that the above-described operation can be repeated.

The invention has been described in detail with particular reference to a preferred embodiment thereof, but it will be understood that variations and modifications can be effected within the spirit and scope of the invention.

I claim:

1. In an electrographic copier having a plurality of electrographic process stations for forming visible images on the surface of discrete dielectric sheets, apparatus for establishing a predetermined operative interface between a discrete dielectric sheet and an electrographic process station so that the function of such process station is uniformly applied to the surface of such dielectric sheet, said apparatus comprising:

means for selectively supporting a discrete dielectric sheet a predetermined distance from a process station, said supporting means including a member having a sheet supporting surface mounted for movement along a path from a location remote from such process station to a location a predetermined distance from such process station and then away from such process station;

means for moving the supporting surface of said member along such path;

means associated with said member for clamping an edge of a discrete dielectric sheet to said member; and means for tacking successive portions of the surface area of said discrete dielectric sheet, measured from such clamped edge, to said supporting surface of said member as such portions are moved with said supporting surface to such location a predetermined distance from such process station, whereby the function of said process station is uniformly applied to the surface of such sheet.

2. The invention of claim 1 wherein said member of said supporting means is a rotatable cylinder, the peripheral surface of such cylinder being the sheet supporting surface, said cylinder having a recess defined in its sheet supporting surface for accomodating the lead edge of a discrete dielectric sheet, and wherein said clamping means is located adjacent to such recess to selectively clamp such lead edge in such recess.

3. The invention of claim 2 wherein said cylinder has a hollow interior chamber and defines a plurality of ports communicating between such chamber and the sheet supporting surface of said cylinder, and wherein said tacking means includes a vacuum source operatively coupled to said chamber and effective through said ports to tack successive elements of the surface area of a clamped sheet to said sheet supporting surface of said cylinder.

4. In an electrographic copier having a plurality of electrographic process stations for forming visible images on the surface of discrete dielectric sheets, apparatus for establishing a predetermined operative interface between a discrete dielectric sheet and an electrographic process station so that the function of such process station is uniformly applied to the surface of such dielectric sheet, said apparatus comprising:

means for selectively supporting a discrete dielectric sheet a predetermined distance from a process station, said supporting means including a member having a sheet supporting surface mounted for movement along a path from a location remote from such process station to a location a predetermined distance from such process station and then away from such process station;

means for moving the sheet supporting surface of said member along such path;

means for guiding a dielectric sheet to said member upstream of such process station and away from said member downstream of such process station;

means associated with said member for clamping the lead edge of a discrete dielectric sheet to said member; and means for tacking successive portions of the surface area of such discrete dielectric sheet, measured from such lead edge, to said sheet supporting surface of said member as such portions are moved with said supporting surface to such location a predetermined distance from such process station, whereby the function of said process station is uniformly applied to the surface of such sheet.

5. The invention of claim 4 wherein said member of said supporting means is rotatable cylinder, the peripheral surface of such cylinder being the sheet supporting surface, said cylinder having a recess defined in its sheet supporting surface for accomodating the lead edge of a discrete dielectric sheet, and wherein said clamping means is located adjacent to such recess to selectively clamp such lead edge in such recess.

6. The invention of claim 5 wherein said guiding means is a track assembly adapted to support opposed marginal edges of discrete dielectric sheets, a first section of said track assembly defining a plane tangent to said cylinder upstream of such associated electrographic process station, and a second section of said track assembly defining a plane tangent to said cylinder downstream of such associated station.

7. The invention of claim 6 wherein said second portion of said track assembly includes an extended portion lying in the path of movement of a dielectric sheet to facilitate removal of such sheet from said cylinder.

* * * * *